US008465017B1

(12) United States Patent
Hayakawa

(10) Patent No.: US 8,465,017 B1
(45) Date of Patent: Jun. 18, 2013

(54) SUPPLY DEVICE AND IMAGE FORMING APPARATUS

(75) Inventor: Yuji Hayakawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/553,259

(22) Filed: Jul. 19, 2012

(30) Foreign Application Priority Data

Mar. 22, 2012 (JP) ..... 2012-065582

(51) Int. Cl.
*B65H 3/06* (2006.01)

(52) U.S. Cl.
USPC ..... 271/117; 271/118

(58) Field of Classification Search
USPC ..... 271/117, 118
See application file for complete search history.

(56) References Cited

U.S. PATENT DOCUMENTS 5,709,380 A * 1/1998 Petocchi et al. ..... 271/125
7,510,180 B2 * 3/2009 Jang et al. ..... 271/127
7,516,953 B2 * 4/2009 Lee ..... 271/117
2004/0021264 A1 * 2/2004 Gaarder et al. ..... 271/117
2006/0267269 A1 11/2006 Yano et al.
2009/0079126 A1 * 3/2009 Hattori ..... 271/117
2009/0200729 A1 * 8/2009 Okamoto ..... 271/117

FOREIGN PATENT DOCUMENTS

JP 2006-315797 A 11/2006
JP 4123444 B2 7/2008

* cited by examiner

*Primary Examiner* — David H Bollinger
(74) *Attorney, Agent, or Firm* — Sughrue Mion, PLLC

(57) ABSTRACT

A supply device includes: a supply roller that rotates around a first axis and supplies a medium; a rotary unit that rotates around a second axis in a determined direction to move the roller from a first position to a second position; a restriction part that, when the roller is at the first position, restricts rotation of the rotary unit in the determined direction; a member that rotates around a third axis; and a swing part that, when rotation of the rotary unit in the determined direction is restricted, swings in a first direction and makes the member separate the restriction part from the rotary unit to move the roller to the second position, and that, when the roller is at the second position, swings in a second direction and rotates the rotary unit in a direction opposite to the determined direction to move the roller to the first position.

5 Claims, 6 Drawing Sheets

SUPPLY DEVICE AND IMAGE FORMING APPARATUS

CROSS-REFERENCE TO RELATED APPLICATIONS

This application is based on and claims priority under 35 USC 119 from Japanese Patent Application No. 2012-065582 filed Mar. 22, 2012.

BACKGROUND

1. Technical Field

The present invention relates to a supply device and an image forming apparatus.

2. Summary

According to an aspect of the invention, there is provided a supply device including a supply roller, a rotary unit, a restriction part, a member, and a swing part. The supply roller rotates around a first axis and supplies a medium. The rotary unit supports the supply roller at the first axis, and rotates in a determined direction around a second axis different from the first axis to thereby move the supply roller from a first position separated from the medium to a second position in contact with the medium. When the supply roller is located at the first position, the restriction part comes into contact with the rotary unit and restricts the rotation of the rotary unit in the determined direction. Upon receipt of drive force, the member rotates around a third axis different from the second axis. Upon receipt of drive force when the rotation of the rotary unit in the determined direction is restricted by the restriction part, the swing part swings in a first direction and causes the member to press and separate the restriction part from the rotary unit, to thereby rotate the rotary unit in the determined direction and move the supply roller to the second position. Further, upon receipt of drive force from the member when the supply roller is located at the second position, the swing part swings in a second direction opposite to the first direction and comes into contact with the rotary unit, to thereby rotate the rotary unit in a direction opposite to the determined direction and move the supply roller to the first position.

BRIEF DESCRIPTION OF THE DRAWINGS

An exemplary embodiment of the present invention will be described in detail based on the following figures, wherein.

DETAILED DESCRIPTION

1. Exemplary Embodiment

1-1. Overall Configuration

Figure 1:
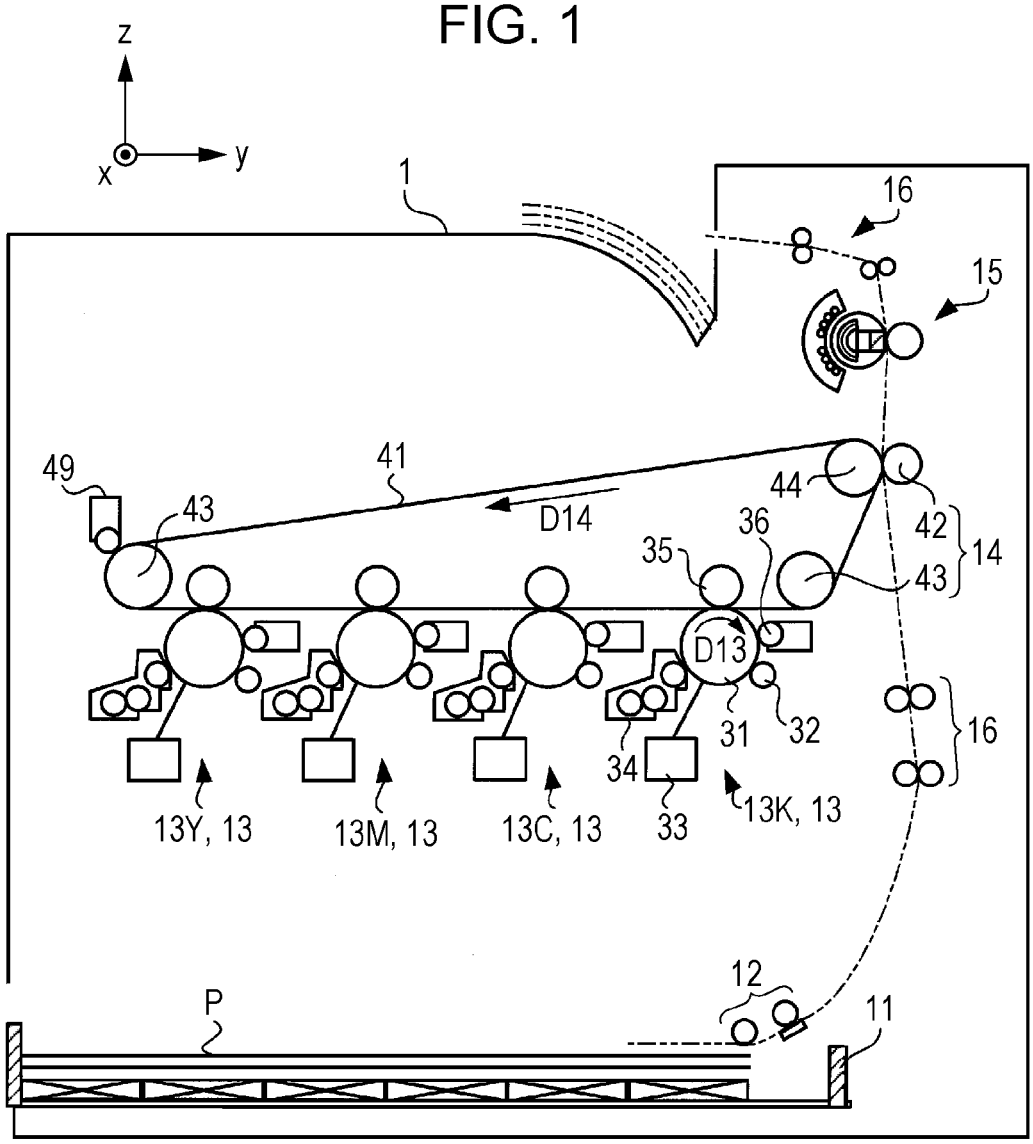
FIG. 1 is a diagram illustrating an overall configuration of an image forming apparatus according to the present exemplary embodiment.

FIG. 1 is a diagram illustrating an overall configuration of an image forming apparatus 1 according to the present exemplary embodiment. As illustrated in the drawing, the image forming apparatus 1 includes a container 11, a supply section 12, developing units 13Y, 13M, 13C, and 13K, a transfer unit 14, a heating unit 15, and a transport unit 16. Alphabetical characters Y, M, C, and K in reference symbols indicate configurations corresponding to yellow, magenta, cyan, and black toners, respectively. The developing units 13Y, 13M, 13C, and 13K are different only in toner to be used, and are not substantially different in configuration. In the following, when it is not particularly necessary to distinguish between the developing units 13Y, 13M, 13C, and 13K, the developing units 13Y, 13M, 13C, and 13K will be referred to as the "developing units 13," with omission of the alphabetical characters at the ends of the reference symbols indicating toner colors.

The container 11 stores sheets P each cut into a predetermined size and serving as a medium. The supply section 12 includes a supply unit which comes into contact with and supplies the sheets P to the transport unit 16. In accordance with an instruction from a not-illustrated controller, the sheets P stored in the container 11 are extracted one by one and supplied to the transport unit 16 by the supply unit. The medium is not limited to a paper sheet, and may be a sheet made of a resin, for example. That is, it suffices if the medium allows an image to be recorded on a surface thereof.

The transport unit 16 includes transport rollers. The transport unit 16 transports to the transfer unit 14 the sheet P supplied from the supply section 12. The transport unit 16 further transports to the outside of a housing of the image forming apparatus 1 the sheet P having passed the transfer unit 14 and the heating unit 15.

Each of the developing units 13 includes a photoconductor drum 31, a charging device 32, an exposure device 33, a developing device 34, a first transfer roller 35, and a drum cleaner 36. The photoconductor drum 31 is an image carrier including a charge generating layer and a charge transporting layer, and is rotated in the direction of an arrow D13 in the drawing by a not-illustrated drive unit. The charging device 32 charges a surface of the photoconductor drum 31. The exposure device 33 includes a laser light emission source and a polygon mirror (both not illustrated). Under a control of the controller, the exposure device 33 radiates laser light according to image data to the photoconductor drum 31 charged by the charging device 32. Thereby, latent images are held by the respective photoconductor drums 31. The above-described image data may be acquired by the controller from an external device via a not-illustrated communication unit. The external device may be, for example, a reading device which reads an original image or a storage device which stores data representing an image.

The developing device 34 stores a two-component developer containing a toner of one of the Y, M, C, and K colors and a magnetic carrier made of ferrite powder or the like. Further, when the tips of spikes of a magnetic brush formed in the developing device 34 come into contact with the surface of the photoconductor drum 31, the toner adheres to a portion of the surface of the photoconductor drum 31 exposed to the laser light by the exposure device 33, i.e., adheres to an image area corresponding to the electrostatic latent image. Thereby, an image is formed (developed) on the photoconductor drum 31.

The first transfer roller 35 generates a predetermined potential difference at a position at which an intermediate transfer belt 41 of the transfer unit 14 faces the photoconductor drum 31. With this potential difference, the first transfer roller 35 transfers the image to the intermediate transfer belt 41. The drum cleaner 36 removes untransferred toner remaining on the surface of the photoconductor drum 31 after the transfer of the image, and discharges the surface of the photoconductor drum 31. That is, the drum cleaner 36 removes unnecessary toner and charge from the photoconductor drum 31 in preparation for the next image formation.

The transfer unit 14 includes the intermediate transfer belt 41, a second transfer roller 42, belt transport rollers 43, and a backup roller 44, and transfers the image formed by the developing unit 13 to the sheet P of a sheet type determined in accordance with an operation by a user. The intermediate transfer belt 41 is an endless belt member. The belt transport rollers 43 and the backup roller 44 stretch the intermediate transfer belt 41. At least one of the belt transport rollers 43 and the backup roller 44 is provided with a drive unit (not illustrated) to move the intermediate transfer belt 41 in the direction of an arrow D14 in the drawing. Any of the belt transport rollers 43 and the backup roller 44 not having the drive unit is driven to rotate by the movement of the intermediate transfer belt 41. In accordance with the movement and rotation of the intermediate transfer belt 41 in the direction of the arrow D14 in the drawing, the image on the intermediate transfer belt 41 is moved to an area between the second transfer roller 42 and the backup roller 44.

With a potential difference between the second transfer roller 42 and the intermediate transfer belt 41, the second transfer roller 42 transfers the image on the intermediate transfer belt 41 to the sheet P transported from the transport unit 16. A belt cleaner 49 removes untransferred toner remaining on a surface of the intermediate transfer belt 41. Then, the transfer unit 14 and the transport unit 16 transport to the heating unit 15 the sheet P having the image transferred thereto. The combination of the developing units 13 and the transfer unit 14 is an example of an image forming unit of the invention, which forms an image on a medium.

The heating unit 15 includes, for example, a magnetic field generating circuit which generates a magnetic field, a heating belt which generates heat by electromagnetic induction caused by the action of the generated magnetic field, and a pressure roller which transports the sheet P by nipping the sheet P between the heating belt and the pressure roller. The heating unit 15 heats the sheet P to thereby fix the image transferred to the sheet P.

1-2. Configuration of Supply Section

Figure 2:
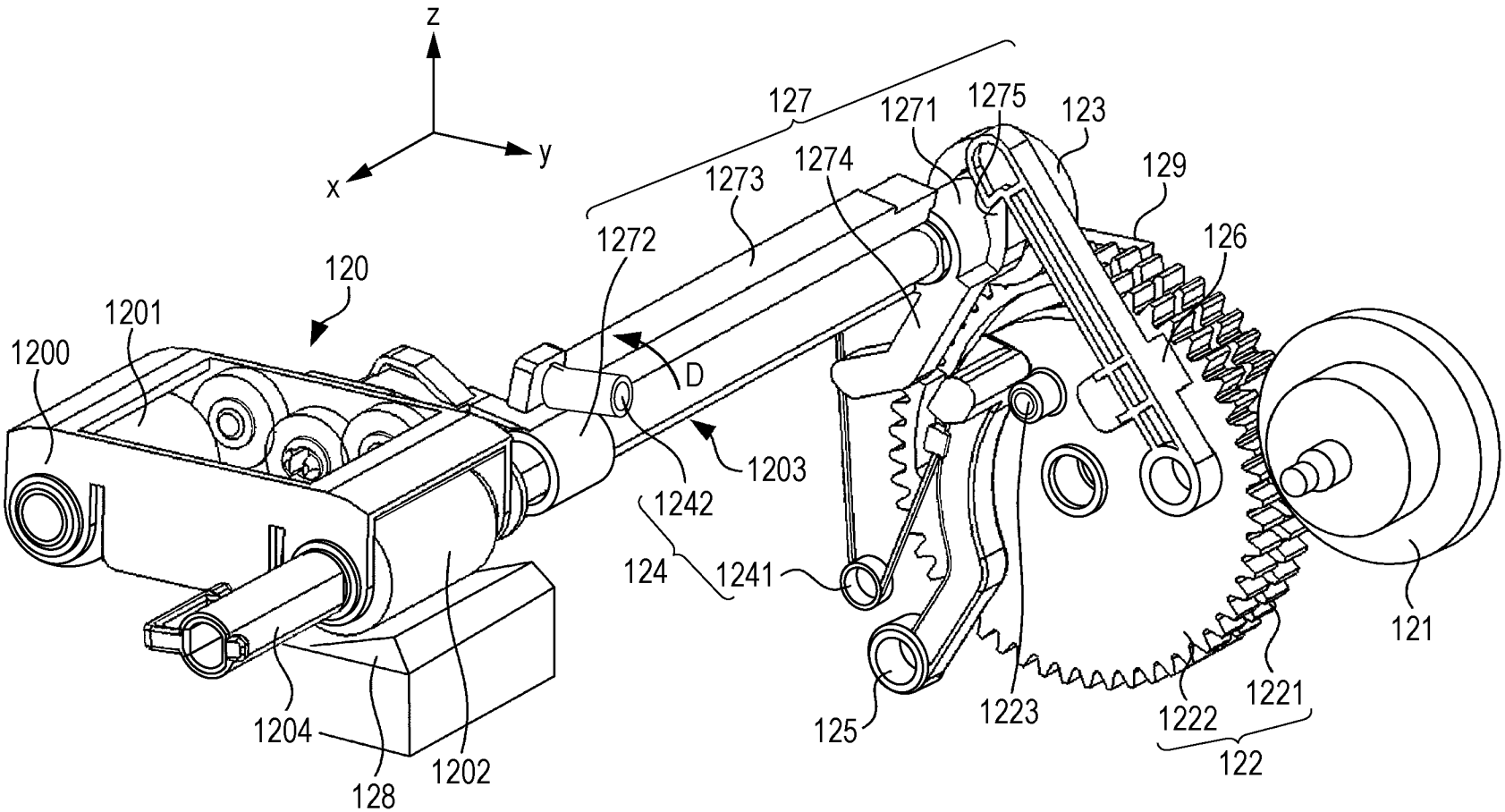
FIG. 2 is a diagram illustrating an overview of a supply section.

FIG. 2 is a diagram illustrating an overview of the supply section 12. In the following drawings, to describe the arrangement of respective configurations of the supply section 12, the space in which the configurations are arranged will be illustrated as a right-handed xyz coordinate space. Further, among coordinate symbols illustrated in the drawings, a symbol of a black dot drawn inside a white circle represents an arrow directed from the far side toward the near side in the drawings. In the space, directions along the x-axis will be referred to as the x-axis directions. Further, one of the x-axis directions in which the x-component is increased will be referred to as the +x direction, and the other x-axis direction in which the x-component is reduced will be referred to as the −x direction. Further, y-axis directions, a +y direction, a −y direction, z-axis directions, a +z direction, and a −z direction are also defined in terms of the y-component and the z-component, respectively. The direction in which the supply section 12 extracts the sheets P from the container 11 and supplies the sheets P to the transport unit 16 corresponds to the +y direction. Further, the direction in which the sheets P are stacked in the container 11 corresponds to the +z direction, and the width direction of the sheets P corresponds to the x-axis directions.

A drive gear 121 revolves around an axis parallel to the x-axis directions. The drive gear 121 rotates a segment gear 122 by meshing with a first segment gear 1221 of the segment gear 122.

The segment gear 122 includes the first segment gear 1221 disposed on the −x direction side and a second segment gear 1222 disposed on the +x direction side. The first segment gear 1221 and the second segment gear 1222 have a common axis parallel to the x-axis directions, and rotate around the axis. The first segment gear 1221 and the second segment gear 1222 are bonded to each other. Each of the first segment gear 1221 and the second segment gear 1222 includes, in a circumferential surface thereof, a tooth-missing region missing a tooth, which is provided at a position different from the position of the tooth-missing region of the other segment gear. When the first segment gear 1221 is rotated by the drive gear 121, the second segment gear 1222 rotates in accordance with the rotation of the first segment gear 1221. A projecting portion 1223 projects in the +x direction from a +x direction-side surface of the second segment gear 1222, and comes into contact with and moves a swing part 125 and a restriction part 126. The projecting portion 1223 functions as a member which rotates around an axis parallel to the x-axis directions with drive force received from the drive gear 121.

A stopper 129 is a member which, when pressed against a hook portion (not illustrated) of the first segment gear 1221 by a not-illustrated solenoid or the like, stops the rotation of the segment gear 122. When the stopper 129 separates from the hook portion of the first segment gear 1221, the segment gear 122 is brought into a rotatable state.

A supply gear 123 rotates around an axis parallel to the x-axis directions. The supply gear 123 meshes with the second segment gear 1222, and rotates in accordance with the rotation of the second segment gear 1222.

A supply unit 120 includes a case 1200, a supply roller 1201, a separation roller 1202, a shaft 1203, and a fastening member 1204. The shaft 1203 is a rod-shaped member extending in the x-axis directions. The shaft 1203 has a −x direction-side end portion coaxially connected to the supply gear 123, and rotates in conjunction with the supply gear 123. The separation roller 1202 is provided to the shaft 1203, and supplies the sheets P to the transport unit 16 by separating the sheets P one by one. The supply roller 1201 supplies the sheets P to the separation roller 1202.

The case 1200 houses therein the supply roller 1201 and the separation roller 1202, and supports the supply roller 1201 and the separation roller 1202 at axes corresponding to the respective centers of revolution of the supply roller 1201 and the separation roller 1202. Further, the case 1200 includes a motion transmitting mechanism, such as gears, which transmits motion between the supply roller 1201 and the separation roller 1202. Accordingly, the supply roller 1201 rotates (revolves) in conjunction with the rotation (revolution) of the separation roller 1202. The fastening member 1204 is fit in a +x direction-side end portion of the shaft 1203 to fasten the separation roller 1202 and the case 1200 storing the separation roller 1202 so as not to move in the +x direction. In a state in which the fastening member 1204 is removed from the shaft 1203 in the +x direction, the supply roller 1201, the separation roller 1202, and the case 1200 storing the supply roller 1201 and the separation roller 1202 are attached to the shaft 1203 when moved in the −x direction, and are detached from the shaft 1203 when moved in the +x direction. That is, the supply roller 1201 is attached to or detached from a rotary unit 127 in accordance with the movement of the supply roller 1201 along the axis corresponding to the center of revolution thereof.

The rotary unit 127 is a group of members which rotate around the circumference of the shaft 1203 of the supply unit 120. A first cylinder 1271 and a second cylinder 1272 are cylindrical members each supported via a not-illustrated bearing member to be rotatable around the circumference of the shaft 1203. The bearing member is, for example, a so-called ball bearing, and an inner ring of the bearing member is supported by the outer circumferential surface of the shaft 1203, and an outer ring of the bearing member supports the first cylinder 1271 or the second cylinder 1272. Further, between the outer ring and the inner ring of the bearing member, plural balls or the like are disposed such that the outer ring rotates while sliding on the inner ring. Accordingly, the first cylinder 1271 and the second cylinder 1272 rotate around the axis of the shaft 1203, with the respective inner circumferential surfaces of the first cylinder 1271 and the second cylinder 1272 sliding on the outer circumferential surface of the shaft 1203. A connecting member 1273 is rod-shaped, and extends in the x-axis directions. The connecting member 1273 is connected to the first cylinder 1271 and the second cylinder 1272 to connect the first cylinder 1271 and the second cylinder 1272 together. Accordingly, the first cylinder 1271 and the second cylinder 1272 rotate in conjunction with each other.

The case 1200 of the supply unit 120 is connected to the second cylinder 1272, and rotates in accordance with the rotation of the second cylinder 1272. Accordingly, when the second cylinder 1272 revolves around the axis of the shaft 1203, the supply roller 1201 housed in the case 1200 rotates around the axis, and is placed at the position according to the angle of the rotation.

A lever 1274 and a hook portion 1275 are provided to the first cylinder 1271, and rotate in accordance with the rotation of the first cylinder 1271. The lever 1274 is a rod-shaped member radially extending from the outer circumference of the first cylinder 1271 around the axis of the first cylinder 1271, and includes a portion which comes into contact with the swing part 125. The hook portion 1275 is a hook-shaped part which includes a step between an outer diameter portion of the first cylinder 1271 and a diameter portion larger than the outer diameter of the first cylinder 1271 (hereinafter referred to as the large diameter portion), and which engages with the restriction part 126.

The swing part 125 is a rod-shaped member which is supported by a not-illustrated housing of the image forming apparatus 1, and which swings around an axis parallel to the x-axis directions. Further, the restriction part 126 is a member which is supported by the not-illustrated housing of the image forming apparatus 1, and which rotates around an axis parallel to the x-axis directions. When the restriction part 126 takes a determined posture, the restriction part 126 engages with the hook portion 1275 of the rotary unit 127.

The swing part 125 is pressed by a first spring 1241 of a spring 124. When the stopper 129 separates from the hook portion of the first segment gear 1221, the swing part 125 swings in a direction corresponding to the pressing force (hereinafter referred to as the first direction), and presses the projecting portion 1223 and thereby rotates the segment gear 122. The segment gear 122 having started rotating meshes with and is driven to rotate by the drive gear 121, and thereby continues to rotationally move. Then, the projecting portion 1223, which rotates in accordance with the rotation of the segment gear 122, hits against and moves the restriction part 126. When the segment gear 122 further rotates, the projecting portion 1223 separates from the swing part 125.

Further, when the projecting portion 1223 separated from the swing part 125 moves in accordance with the rotation of the segment gear 122 and again comes into contact with the swing part 125, the swing part 125 swings in a direction against the pressing force of the first spring 1241, i.e., in a direction opposite to the first direction (hereinafter referred to as the second direction), and comes into contact with and moves the lever 1274.

The spring 124 includes the first spring 1241 and a second spring 1242. The first spring 1241 has one end supported by the not-illustrated housing of the image forming apparatus 1 and the other end connected to the swing part 125. Accordingly, the first spring 1241 swings the swing part 125 in the first direction (counterclockwise direction as viewed in the −x direction). The second spring 1242 presses the second cylinder 1272 of the rotary unit 127 in the direction of the arrow D illustrated in FIG. 2, and rotates the rotary unit 127 when the restriction part 126 is not engaged with the hook portion 1275.

A separation plate 128 is provided at a position facing the separation roller 1202 of the supply unit 120. When plural sheets P are supplied from the supply roller 1201, the separation plate 128 comes into contact with the leading ends of the plural sheets P, and sends the sheets P one by one to the space between the separation plate 128 and the separation roller 1202. Thereby, the sheets P are supplied to the transport unit 16.

1-3. Operation

Figure 3:
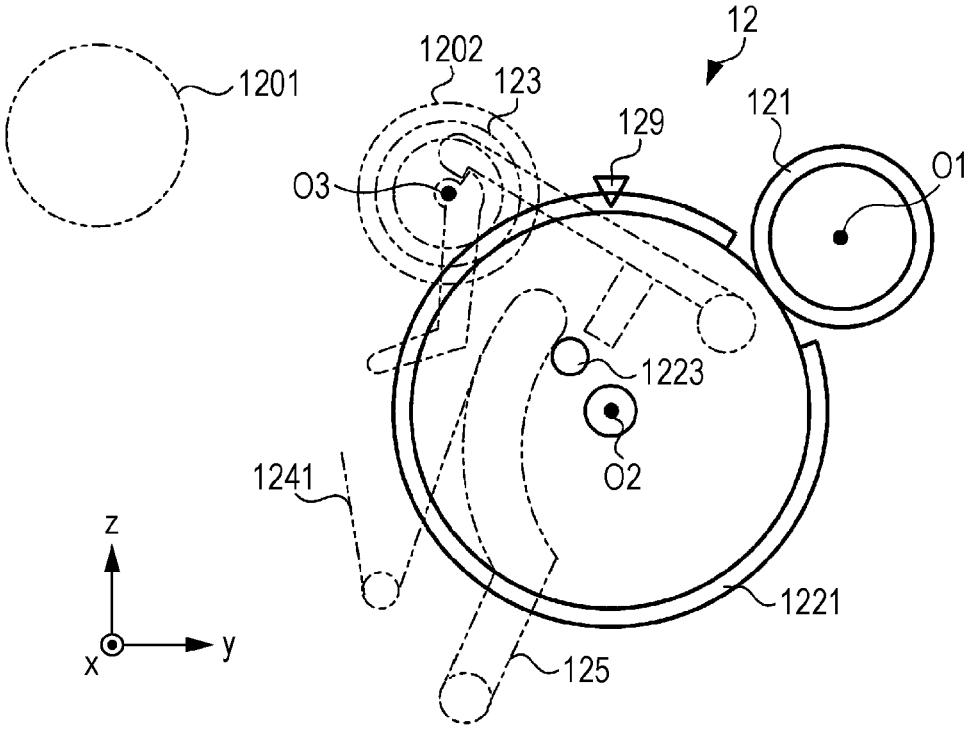
FIG. 3 is a diagram illustrating a first segment gear and a drive gear in an initial state.

An operation of the supply section 12 will be described below. FIG. 3 is a diagram illustrating the first segment gear 1221 and the drive gear 121 in an initial state. Axes O1, O2, and O3 in the drawing are all parallel to the x-axis directions. The drive gear 121 rotates around the axis O1. The segment gear 122 rotates around the axis O2. The supply gear 123 rotates around the axis O3.

The initial state refers to the state in which the stopper 129 is in contact with the hook portion of the first segment gear 1221 and stopping the rotation of the segment gear 122. In the initial state, the tooth-missing region of the first segment gear 1221 is located at a position facing the drive gear 121. Accordingly, the drive gear 121 idles, without meshing with the first segment gear 1221.

Figure 4:
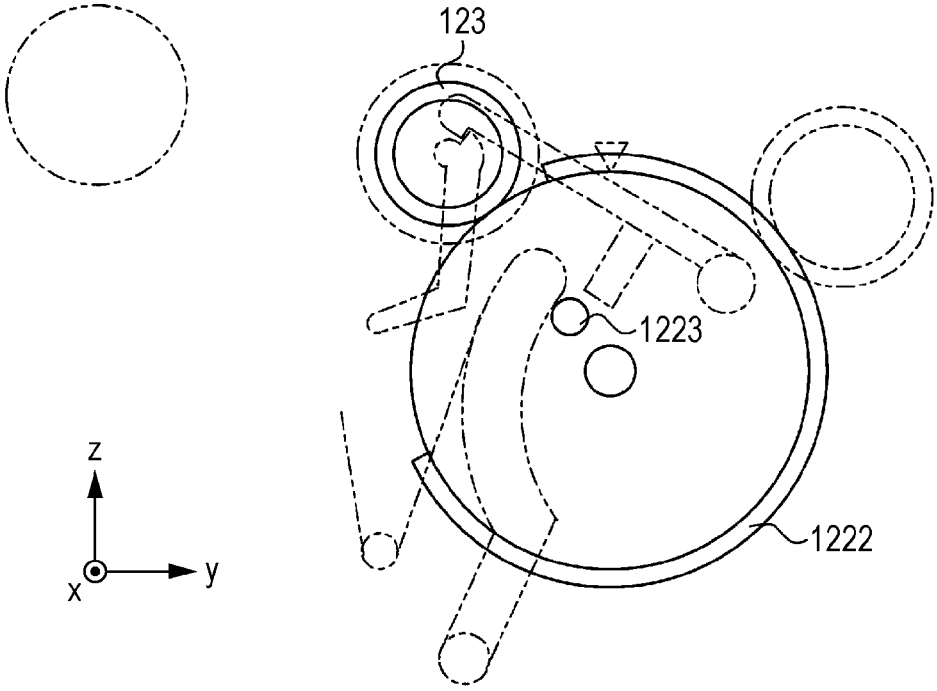
FIG. 4 is a diagram illustrating a second segment gear and a supply gear in the initial state.

FIG. 4 is a diagram illustrating the second segment gear 1222 and the supply gear 123 in the initial state. In the initial state, the tooth-missing region of the second segment gear 1222 is located at a position facing the supply gear 123. That is, the second segment gear 1222 and the supply gear 123 are not meshed with each other. Therefore, the second segment gear 1222 does not rotate the supply gear 123 before the second segment gear 1222 is rotated by a determined angle after the start of the rotation.

Figure 5:
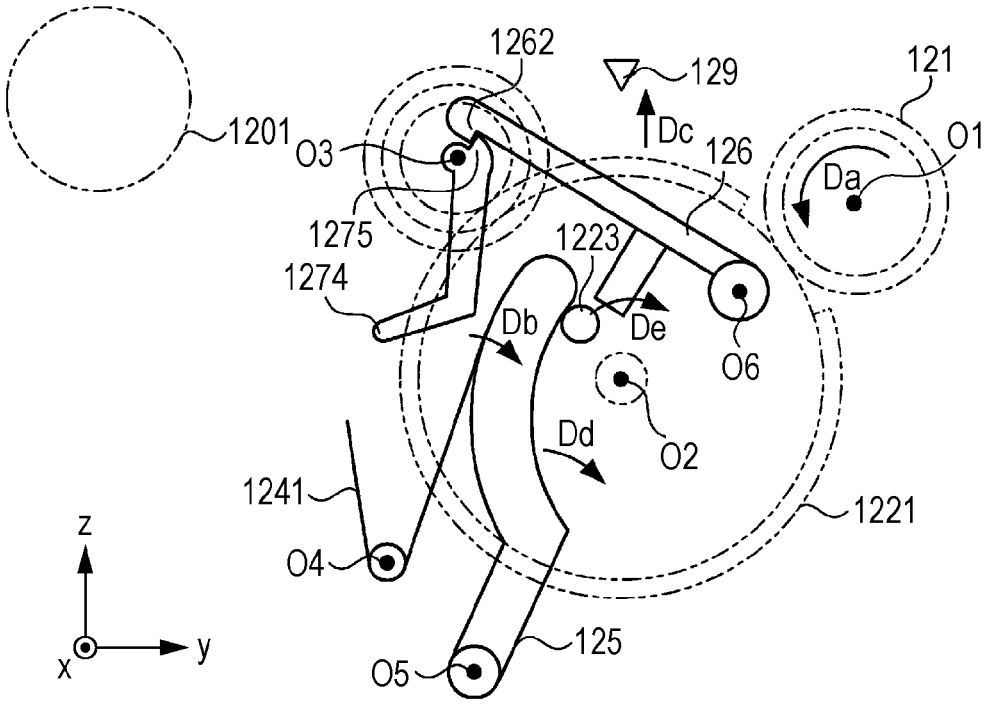
FIG. 5 is a diagram illustrating the arrangement of a swing part, a restriction part, and a rotary unit in the initial state.

FIG. 5 is a diagram illustrating the arrangement of the swing part 125, the restriction part 126, and the rotary unit 127 in the initial state. Axes O4, O5, and O6 are all parallel to the x-axis directions. The first spring 1241 is pressing, around the axis O4, the swing part 125 in the counterclockwise direction, as viewed in the −x direction. The swing part 125 is supported by the not-illustrated housing of the image forming apparatus 1 to be swingable around the axis O5. The restriction part 126 is supported by the not-illustrated housing of the image forming apparatus 1 to be rotatable around the axis O6.

A hook portion 1262 of the restriction part 126 is meshed with the hook portion 1275 of the rotary unit 127. In this state, the centroid of the restriction part 126 is located on the −y direction side of the axis O6. Therefore, the hook portion 1262 of the restriction part 126 presses the hook portion 1275 of the rotary unit 127 from above with the self-weight of the restriction part 126. As a result, the rotary unit 127 takes the posture illustrated in FIG. 5, and determines the position of the supply roller 1201 of the supply unit 120 operating in conjunction with the rotary unit 127. The position of the supply roller 1201 is higher than the uppermost surface of the sheets P stored in the container 11.

The drive gear 121 rotates around the axis O1 in the direction of an arrow Da illustrated in FIG. 5. In the initial state, the drive gear 121 is not in contact with the first segment gear 1221, and thus idles. The first spring 1241 is pressing the swing part 125 in the direction of an arrow Db. When the stopper 129 is engaged with the hook portion of the first segment gear 1221 in the initial state, however, the rotational movement of the projecting portion 1223 is restricted, and thus the swing part 125 does not move. Herein, if the not-illustrated solenoid moves the stopper 129 in the direction of an arrow Dc illustrated in FIG. 5 and brings the first segment gear 1221 into the rotatable state, the swing part 125 is pressed in the direction of the arrow Db by the force of the first spring 1241, and swings in the direction of an arrow Dd (first direction). Thereby, the projecting portion 1223 rotates around the axis O2 (third axis) in the direction of an arrow De, and the segment gear 122 rotates around the axis O2 in the direction of the arrow De.

Figure 6:
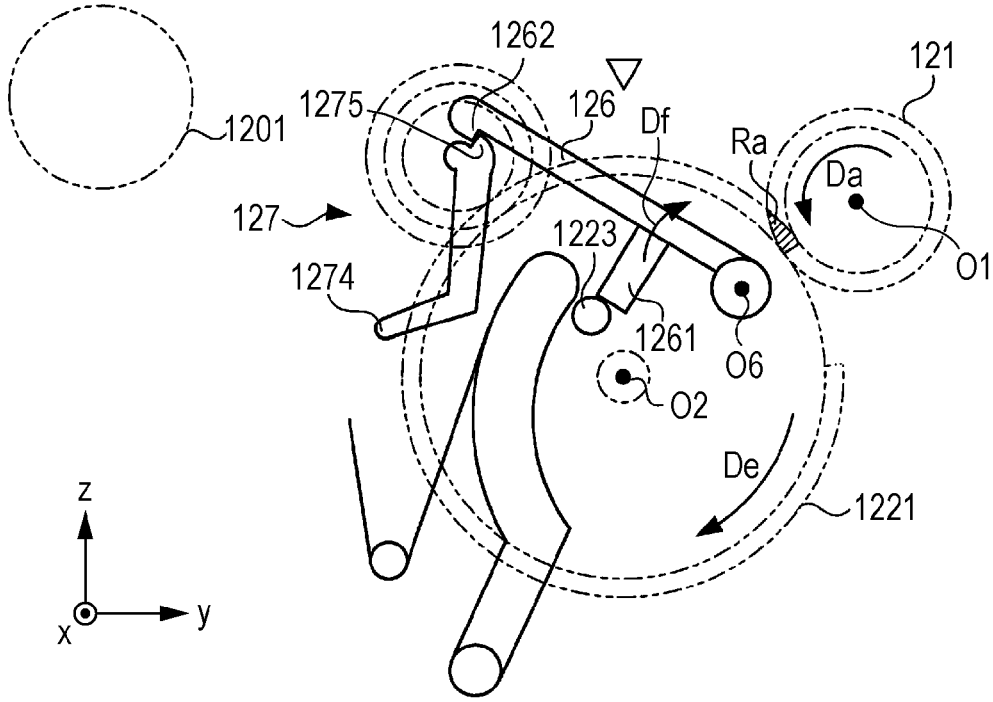
FIG. 6 is a diagram illustrating a state in which a segment gear in the initial state has started rotating.

FIG. 6 is a diagram illustrating a state in which the segment gear 122 in the initial state has started rotating. When the segment gear 122 rotates in the clockwise direction illustrated in FIG. 6, the tooth-missing region of the first segment gear 1221 moves, and teeth of the first segment gear 1221 and the drive gear 121 mesh with each other in a region Ra illustrated in FIG. 6. Thereby, the drive force of the drive gear 121 rotating in the direction of the arrow Da is transmitted to the segment gear 122 via the first segment gear 1221, and the segment gear 122 rotates in the direction of the arrow De. Then, the projecting portion 1223 presses a pressed portion 1261 of the restriction part 126. Therefore, the restriction part 126 rotates around the axis O6 in the direction of an arrow Df. When the restriction part 126 further rotates in the direction of the arrow Df, the hook portion 1262 of the restriction part 126 separates from the hook portion 1275 of the rotary unit 127.

Figure 7:
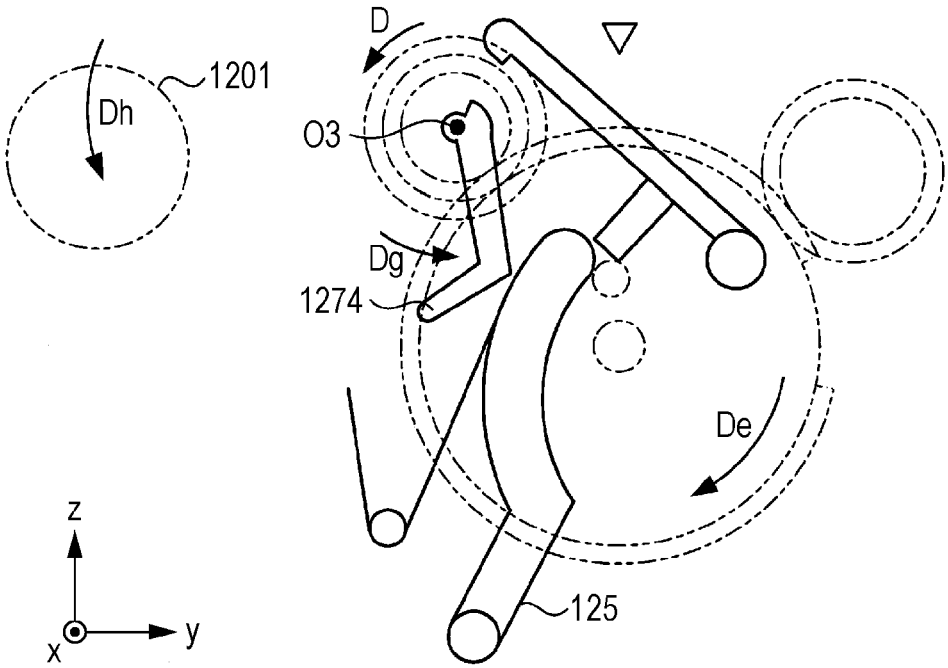
FIG. 7 is a diagram illustrating a state in which the restriction part and the rotary unit are separated from each other.

FIG. 7 is a diagram illustrating a state in which the restriction part 126 and the rotary unit 127 are separated from each other. The rotary unit 127 is pressed in the direction of the arrow D by the second spring 1242 illustrated in FIG. 2. If the hook portion 1262 of the restriction part 126 separates from the hook portion 1275 of the rotary unit 127, therefore, the lever 1274 of the rotary unit 127 rotates around the axis O3 (second axis) in the direction of an arrow Dg.

Further, the case 1200 of the supply unit 120 rotates in accordance with the rotation of the second cylinder 1272. Therefore, the supply roller 1201 housed in the case 1200 rotates around the axis O3 (second axis) in the direction of an arrow Dh. Thereby, the supply roller 1201 moves from a position separated from the sheets P (media) in the not-illustrated container 11 (hereinafter referred to as the first position) to a position in contact with the sheets P (hereinafter referred to as the second position), and takes a posture in which the supply roller 1201 is capable of supplying the sheets P to the separation roller 1202. Then, when the segment gear 122 in the posture illustrated in FIG. 7 further rotates in the direction of the arrow De, the tooth-missing region of the second segment gear 1222 moves, and the supply gear 123 and the second segment gear 1222 mesh with each other. When the supply roller 1201 moves to the second position, the lever 1274 rotates in accordance with the movement, but does not comes into contact with the swing part 125.

Figure 8:
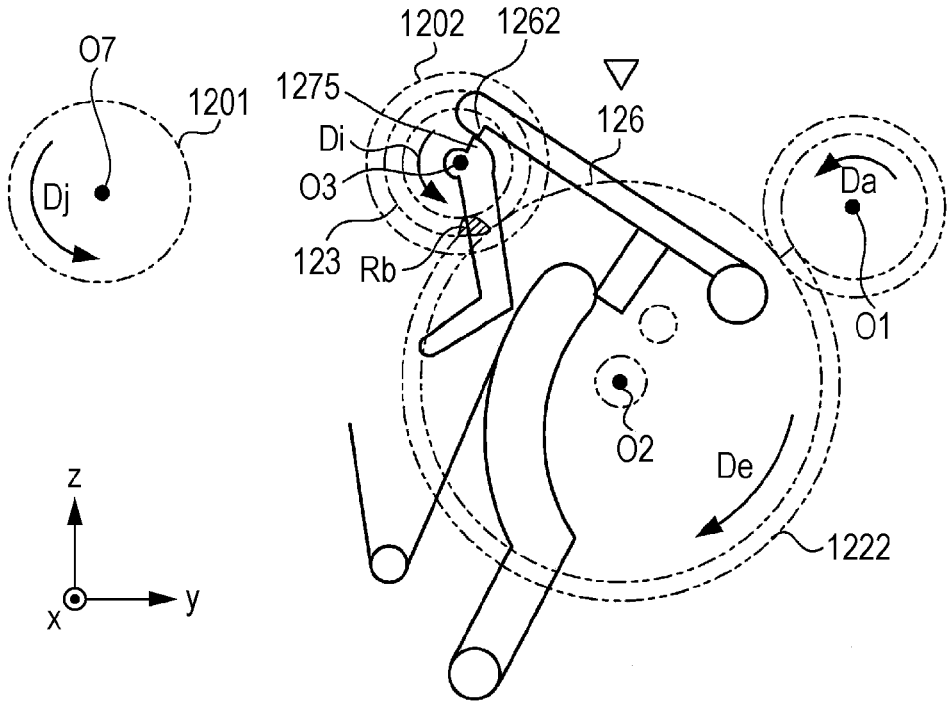
FIG. 8 is a diagram illustrating a state in which the supply gear and the second segment gear are meshed with each other.

FIG. 8 is a diagram illustrating a state in which the supply gear 123 and the second segment gear 1222 are meshed with each other. An axis O7 is parallel to the x-axis directions. In a region Rb illustrated in FIG. 8, the second segment gear 1222 and the supply gear 123 mesh with each other. Thereby, the rotational motion of the segment gear 122 is transmitted to the supply gear 123. Then, the supply gear 123 rotates around the axis O3 in the direction of an arrow Di. The supply gear 123 is provided coaxially with the shaft 1203 illustrated in FIG. 2. When the supply gear 123 rotates in the direction of the arrow Di, therefore, the shaft 1203 rotates in accordance with the rotation, and the separation roller 1202 provided to the shaft 1203 also rotates.

Then, the motion transmitting mechanism, such as gears, provided to the case 1200 transmits the rotational motion of the separation roller 1202 to the supply roller 1201. Thus, the supply roller 1201 rotates (revolves) around the axis O7 (first axis) in the direction of an arrow Dj. The supply roller 1201 thereby supplies the sheets P to the separation roller 1202.

Figure 9:
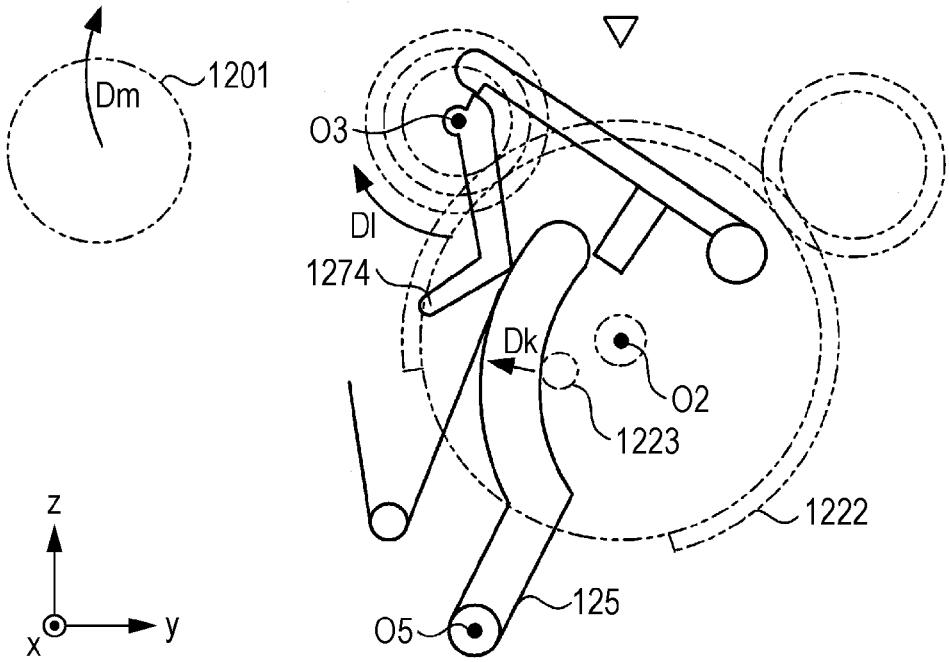
FIG. 9 is a diagram illustrating a state in which a projecting portion is again in contact with the swing part.

When the segment gear 122 further rotates, the projecting portion 1223 again comes into contact with the swing part 125. FIG. 9 is a diagram illustrating a state in which the projecting portion 1223 is again in contact with the swing part 125. The projecting portion 1223 rotates around the axis O2. A surface of the swing part 125 facing the axis O2 includes a portion which approaches the axis O2 when moving in the clockwise direction illustrated in FIG. 9. When the projecting portion 1223 rotates around the axis O2 in the clockwise direction in FIG. 9, therefore, the projecting portion 1223 presses the swing part 125 in a direction of separating the swing part 125 from the axis O2. As a result, the swing part 125 swings around the axis O5 in the direction of an arrow Dk illustrated in FIG. 9 (second direction), and comes into contact with the lever 1274 of the rotary unit 127. Then, the lever 1274 of the rotary unit 127 is pressed by the swing part 125, and rotates around the axis O3 in the direction of an arrow Dl. The supply roller 1201 of the supply unit 120 operates in conjunction with the rotary unit 127, and thus rotates around the axis O3 in the direction of an arrow Dm. Thereby, the supply roller 1201 moves from the second position to the first position, and thus separates from the sheets P stored in the container 11.

Figure 10:
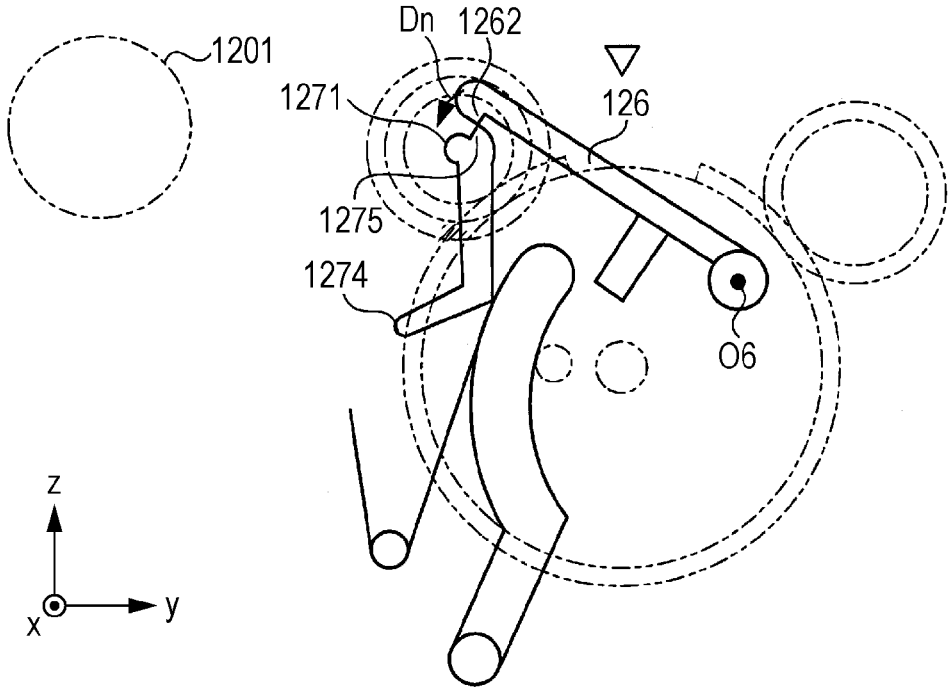
FIG. 10 is a diagram illustrating a state in which the movement of the rotary unit is restricted by the restriction part.

FIG. 10 is a diagram illustrating a state in which the movement of the rotary unit 127 is restricted by the restriction part 126. The restriction part 126 rotates around the axis O6 in the direction of an arrow Dn with the self-weight thereof. When the swing part 125 presses and moves the lever 1274, the hook portion 1275 rotates in the clockwise direction in FIG. 10, and the hook portion 1262 mounted on the large diameter portion of the hook portion 1275 falls to a position in contact with the outer diameter of the first cylinder 1271. Thereby, the hook portion 1262 of the restriction part 126 and the hook portion 1275 of the rotary unit 127 mesh with each other, and the counterclockwise rotation of the rotary unit 127 in FIG. 10 is restricted by the restriction part 126. When the segment gear 122 further rotates thereafter, the swing part 125 returns to the position thereof in the initial state, and separates from the lever 1274. That is, at the position of the swing part 125 in the initial state, the swing part 125 is not applied with the force of the rotary unit 127. In the initial state, therefore, the segment gear 122 is not applied with the force applied to the rotary unit 127 by the second spring 1242. Further, in the initial state, the segment gear 122 is not in contact with the supply gear 123. Therefore, the segment gear 122 is not applied with resisting force of the supply gear 123.

Accordingly, when the segment gear 122 returns to the initial state, the force applied to the rotary unit 127 by the second spring 1242 is restricted by the restriction part 126. Further, the segment gear 122 having returned to the initial state is in a posture in which the tooth-missing region of the segment gear 122 faces the supply gear 123. Thus, the segment gear 122 is not applied with the resisting force of the supply gear 123. Therefore, it suffices if the force of the stopper 129 for keeping the segment gear 122 at rest in the initial state balances with the force of the first spring 1241 pressing the swing part 125. That is, the posture of the stopper 129 is maintained by a relatively small-sized solenoid, and thus the manufacturing cost of the image forming apparatus 1 is suppressed.

Further, the supply roller 1201 rotates around the axis around which the rotary unit 127 revolves. Thus, the supply roller 1201 is placed at the position according to the angle of rotation of the rotary unit 127. For example, therefore, if the number of the sheets P stored in the container 11 is increased or reduced in accordance with a change in specifications, an adjustment to place the supply roller 1201 at the position according to the increase or reduction is performed more easily than in, for example, a configuration described in Japanese Unexamined Patent Application Publication No. 2006-315797 (hereinafter referred to as Patent Document 1).

If the number of sheets is increased or reduced in accordance with a change in specifications, the adjustment is more difficult to perform in the configuration described in Patent Document 1 than in the above-described configuration of the supply section 12 for the following reason. In the configuration described in Patent Document 1, an MP sheet feed roller is lowered upon release of engagement between the MP sheet feed roller and a support arm pressed by a pressing member. However, the above-described engagement is released when support arm rotates not around the axis of an MP separation roller but in a horizontal direction. Therefore, the direction and distance of descent of the MP sheet feed roller are not proportional to the direction and distance of pressing of the support arm by the pressing member. In the configuration described in Patent Document 1, therefore, it is necessary to change the release position of the engagement of a left end portion of the support arm to change the distance of descent of the MP sheet feed roller, and thus a change in design, such as a change in length of the support arm, is required.

Further, in the configuration described in Patent Document 1, it is required to increase the size of the support arm in accordance with an increase in distance of movement of the MP sheet feed roller. Thus, this configuration may prevent the saving of space of the image forming apparatus. Meanwhile, the above-described lever 1274 allows the distance of movement of the supply roller 1201 to be changed in accordance with the adjustment of the angle of contact between the lever 1274 and the swing part 125, without a change in size of the lever 1274.

Further, in the configuration of Patent Document 1, the support art needs to be lifted in the replacement of the MP sheet feed roller. Meanwhile, the supply unit 120 is fastened by the fastening member 1204 disposed on the +x direction side of the supply unit 120. In the replacement of the supply unit 120, therefore, the supply unit 120 is removable from the shaft 1203 in the +x direction after detachment of the fastening member 1204 from the shaft 1203.

2. Modified Examples

The above is the description of the exemplary embodiment. However, the contents of the exemplary embodiment may be modified as follows. Further, the following modified examples may be combined.

2-1. First Modified Example

In the above-described exemplary embodiment, the swing part 125 is pressed by the first spring 1241 of the spring 124. However, the swing part 125 may be configured to rotate in the direction of the arrow Db illustrated in FIG. 5 with the self-weight thereof. In this case, the first spring 1241 may be omitted. Further, it suffices if the centroid of the swing part 125 is located on the +y direction side of the axis O5, and if the force of the swing part 125 for rotating the segment gear 122 exceeds the inertial force of the segment gear 122 when the stopper 129 stops restricting the movement of the segment gear 122.

2-2. Second Modified Example

In the above-described exemplary embodiment, the second spring 1242 presses the second cylinder 1272 of the rotary unit 127 in the direction of the arrow D illustrated in FIG. 2, and rotates the rotary unit 127 when the restriction part 126 is not engaged with the hook portion 1275. However, the exemplary embodiment may be modified such that, when the restriction part 126 is not engaged with the hook portion 1275, the rotary unit 127 rotates with the self-weight of the supply unit 120. In this case, the second spring 1242 may be omitted.

2-3. Third Modified Example

In the above-described exemplary embodiment, the projecting portion 1223 functions as a member which rotates around an axis parallel to the x-axis directions with the drive force received from the drive gear 121. However, the axis around which the projecting portion 1223 rotates may not be parallel to the x-axis directions. For example, the segment gear 122 and the supply gear 123 may be "bevel gears," with respective axes thereof crossing each other at an acute angle, and the projecting portion 1223 projecting from the segment gear 122 may rotationally move along a plane inclined relative to the swing direction of the swing part 125. Also in this case, it suffices if the projecting portion 1223 approaches and comes into contact with the swing part 125 and moves away and separates from the swing part 125 along the swing direction of the swing part 125. That is, it suffices if the projecting portion 1223 is a member which rotates around an axis to thereby exchange motion with the swinging swing part 125.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A supply device comprising:

a supply roller that rotates around a first axis and supplies a medium;

a rotary unit that supports the supply roller at the first axis, and rotates in a determined direction around a second axis different from the first axis to thereby move the supply roller from a first position separated from the medium to a second position in contact with the medium;

a restriction part that, when the supply roller is located at the first position, comes into contact with the rotary unit and restricts the rotation of the rotary unit in the determined direction;

a member that, upon receipt of drive force, rotates around a third axis different from the second axis; and a swing part that, upon receipt of drive force when the rotation of the rotary unit in the determined direction is restricted by the restriction part, swings in a first direction and causes the member to press and separate the restriction part from the rotary unit, to thereby rotate the rotary unit in the determined direction and move the supply roller to the second position, and that, upon receipt of drive force from the member when the supply roller is located at the second position, swings in a second direction opposite to the first direction and comes into contact with the rotary unit, to thereby rotate the rotary unit in a direction opposite to the determined direction and move the supply roller to the first position.

2. The supply device according to claim 1, wherein, when the rotation of the rotary unit in the determined direction is restricted by the restriction part, the swing part is located at a position at which the swing part is not applied with force by the rotary unit.

3. The supply device according to claim 1, wherein the supply roller is attached to or detached from the rotary unit in accordance with the movement of the supply roller in a direction along the first axis.

4. The supply device according to claim 2, wherein the supply roller is attached to or detached from the rotary unit in accordance with the movement of the supply roller in a direction along the first axis.

5. An image forming apparatus comprising:

the supply device according to claim 1; and an image forming unit that forms an image on the medium supplied by the supply device.

* * * * *